US009699858B2

(12) United States Patent
Laherty et al.

(10) Patent No.: US 9,699,858 B2
(45) Date of Patent: Jul. 4, 2017

(54) NETWORK CONTROLLED MULTI-COLOR LIGHTING SERVICES

(71) Applicant: Cisco Technology, Inc., San Jose, CA (US)

(72) Inventors: Matthew A. Laherty, Bloomington, IN (US); Donald Schriner, Fishers, IN (US); William MacGowan, Toronto (CA); Charles Calvin Byers, Wheaton, IL (US)

(73) Assignee: Cisco Technology, Inc., San Jose, CA (US)

( * ) Notice: Subject to any disclaimer, the term of this patent is extended or adjusted under 35 U.S.C. 154(b) by 146 days.

(21) Appl. No.: 14/563,471

(22) Filed: Dec. 8, 2014

(65) Prior Publication Data

US 2016/0165679 A1 Jun. 9, 2016

(51) Int. Cl.
*H05B 33/08* (2006.01)
*G09F 9/302* (2006.01)
(Continued)

(52) U.S. Cl.
CPC ..... *H05B 33/086* (2013.01); *G09F 9/3023* (2013.01); *H05B 37/0254* (2013.01);
(Continued)

(58) Field of Classification Search
CPC ..... G09F 9/33; G09F 9/3026; G09F 19/22; G09F 19/26; G09F 19/28;
(Continued)

(56) References Cited

U.S. PATENT DOCUMENTS 6,646,545 B2 * 11/2003 Bligh ..... G08B 7/062 340/286.05
7,619,538 B1 * 11/2009 Zarian ..... G08B 7/062 340/326

(Continued)

OTHER PUBLICATIONS

Dhanjani, "Hacking Lightbulbs: Security Evaluation of the Philips hue Personal Wireless Lighting System", Internet of Things Security Evaluation Series, Aug. 2013, 46 pages.

(Continued)

*Primary Examiner* — Thai Pham
*Assistant Examiner* — Borna Alaeddini
(74) *Attorney, Agent, or Firm* — Edell, Shapiro & Finnan, LLC

(57) ABSTRACT

Techniques presented herein are directed to the coordinated network-based control of the color capabilities of multi-color fixtures. A network device is connected to multi-color light fixtures each comprising a local processor and a plurality of color light emitters. The network device receives data inputs from one or more data sources and uses the data inputs to identify a color informational display for presentation across a plurality of the multi-color light fixtures. The network device generates messages encoding light control settings for each of the plurality of multi-color light fixtures enabling each multi-color light fixture to present a spatial or temporal segment of the color informational display and sends the messages to the plurality of light fixtures. Execution of instructions embedded in the messages by the local processors results in the creation of the color informational display across the plurality of multi-color light fixtures.

23 Claims, 4 Drawing Sheets

(51) Int. Cl.
*H05B 37/02* (2006.01)
*G09F 13/22* (2006.01)
*G09F 13/04* (2006.01)

(52) U.S. Cl.
CPC ..... *G09F 9/302* (2013.01); *G09F 2013/0459* (2013.01); *G09F 2013/222* (2013.01); *H05B 33/0803* (2013.01); *H05B 33/0806* (2013.01); *H05B 33/0815* (2013.01); *H05B 33/0842* (2013.01)

(58) Field of Classification Search
CPC ..... G09F 2013/222; G09F 2013/22; G09F 2013/18; G09F 2013/005; G09F 2013/04; G09F 2013/00; G09F 2013/16; G09F 2013/0459; G09F 2013/1831; G09F 2013/1836; G09F 9/302; G09F 9/3023; G09G 2380/06; G09G 2360/04; G08B 5/38; G08B 7/066; G08B 7/062; G08B 17/10; G08B 27/001; F21Y 2101/02; F21Y 2105/00; F21Y 2105/003; F21Y 2111/007; F21Y 2111/005; F21Y 2111/001; H05B 37/0254; H05B 37/0272; H05B 37/0245; H05B 37/0263; H05B 33/0842; H05B 33/0803; H05B 33/0815; H05B 33/0806; Y02B 20/48; Y02B 20/44
USPC ..... 315/312, 294, 153, 297, 118, 129, 130, 315/134, 291, 318; 362/249.06, 800, 362/97.1, 147
See application file for complete search history.

(56) References Cited

U.S. PATENT DOCUMENTS

| | | | | |
|---|---|---|---|---|
| 8,352,769 | B1 | 1/2013 | Ghose et al. | |
| 8,560,091 | B2 * | 10/2013 | Reumerman | G01C 21/20 340/944 |
| 8,732,501 | B1 | 5/2014 | Ghose et al. | |
| 8,745,429 | B2 | 6/2014 | Ghose et al. | |
| 9,307,621 | B1 * | 4/2016 | Parello | H05B 37/0272 |
| 9,465,984 | B2 * | 10/2016 | Watanabe | G06K 9/00228 |
| 2006/0125657 | A1 * | 6/2006 | Higelin | G01C 22/006 340/944 |
| 2012/0130544 | A1 * | 5/2012 | Mohan | H05B 37/0218 700/275 |
| 2014/0268700 | A1 * | 9/2014 | Mumma | F21V 23/0492 362/183 |
| 2015/0186099 | A1 * | 7/2015 | Hall | H01H 11/04 345/547 |

OTHER PUBLICATIONS

The Enlightener, "Philips HUE: Product of the Year", IES Pittsburgh, Jan. 2013, 2 Pages.
Philips, "Meet hue: The System", http://www2.meethue.com/en-us/what-is-hue/the-system/, Retrieved Dec. 8, 2014, 7 pages.
RAB Lighting, "LED panels for every application-Edge-to-edge light up to 106 lumens per Watt", http://www.rabweb.com/led-panel-lights.php, Retrieved Dec. 8, 2014, 8 pages.
Gilchrist, "Star Trek-Red Alert", YouTube, https://www.youtube.com/watch?v=GZIOxvxtanE, Retrieved Dec. 8, 2014, 31 seconds-33 Seconds and 42 Seconds-43 Seconds, 12 pages.

* cited by examiner

200

| APPLICATION MEANING | COLOR | TIME PATTERN | |
|---|---|---|---|
| FIRE ALARM | RED | STROBE | 205 |
| WMD ALARM | RED-ORANGE-YELLOW | STROBE | |
| SECURITY INTRUSION ALARM | RED-BLUE | STROBE | |
| TOP SECRET CLEARANCE REQUIRED TO ENTER | RED-WHITE-BLUE | FLASH | 210 |
| LOCKDOWN | RED-ORANGE | FLASH | |
| DO NOT ENTER | RED | FLASH | |
| BIOHAZARD / QUARANTINE / STERILE AREA | RED-GREEN | BLINK | 215 |
| MAINTENANCE / CONSTRUCTION UNDERWAY IN AREA | ORANGE | BLINK | |
| AUTONOMOUS VEHICLE OPERATING IN AREA | ORANGE-YELLOW | BLINK | |
| RESTRICTED / PREMIUM AREA | VIOLET | BLINK | |
| MAINTENANCE REQUESTED | YELLOW | BLINK | |
| EMERGENCY EQUIPMENT LOCATION MARKET | RED-ORANGE | WAVER | 220 |
| EXIT / STAIRS | RED-WHITE | WAVER | |
| ROOM BEING SERVICED | ORANGE | WAVER | |
| SECURITY SYSTEM ARMED | RED-BLUE | FADE | 225 |
| MEN'S RESTROOM / LOCKER ROOM LOCATOR | LIGHT BLUE | FADE | |
| WOMEN'S RESTROOM / LOCKER ROOM LOCATOR | PINK | FADE | |
| DRINKING FOUNTAIN / REFRESHMENTS LOCATOR | BLUE | FADE | |
| EMERGENCY EXIT ROUTE | RED-WHITE | CHASE | 230 |
| PATH GUIDANCE | ORANGE | CHASE | |
| SERVER / RACK STATUS / TEMPERATURE | RED/GREEN/BLUE | CONSTANT | 235 |
| PLANT GROW LIGHTS | RED+BLUE | CONSTANT | |
| HIGHLIGHTING RETAIL MERCHANDISE | RAINBOW | ALL | |

FIG.3

NETWORK CONTROLLED MULTI-COLOR LIGHTING SERVICES

TECHNICAL FIELD

The present disclosure relates to the control of light fixtures.

BACKGROUND

Commercial buildings, highways, parks, and other spaces are increasingly being fit with energy efficient light fixtures (e.g., light emitting diode (LED)-based light fixtures). With light fixtures powered and controlled via a communication network, it is possible to provide building tenants, maintenance workers, and even visitors control over the light emitted in their space.

BRIEF DESCRIPTION OF THE DRAWINGS

FIG. 3 is a table illustrating examples of color informational displays that could be presented by networked multi-color light fixtures in accordance with example embodiments presented herein.

DESCRIPTION OF EXAMPLE EMBODIMENTS

Overview

Techniques presented herein are directed to the coordinated network-based control of the color capabilities of networked multi-color fixtures to communicate status or provide advanced services to the occupants of a space. In one example, a network device is connected to multi-color light fixtures each comprising a local processor and a plurality of color light emitters. The network device receives data inputs from one or more data sources and uses the data inputs to identify a color informational display for presentation across a plurality of the multi-color light fixtures. The network device generates messages encoding light control settings for each of the plurality of multi-color light fixtures enabling each multi-color light fixture to present a spatial or temporal segment of the color informational display and sends the messages to the plurality of light fixtures. Execution of instructions embedded in the messages by the local processors results in the creation of the color informational display across the plurality of multi-color light fixtures.

Example Embodiments

Figure 1:
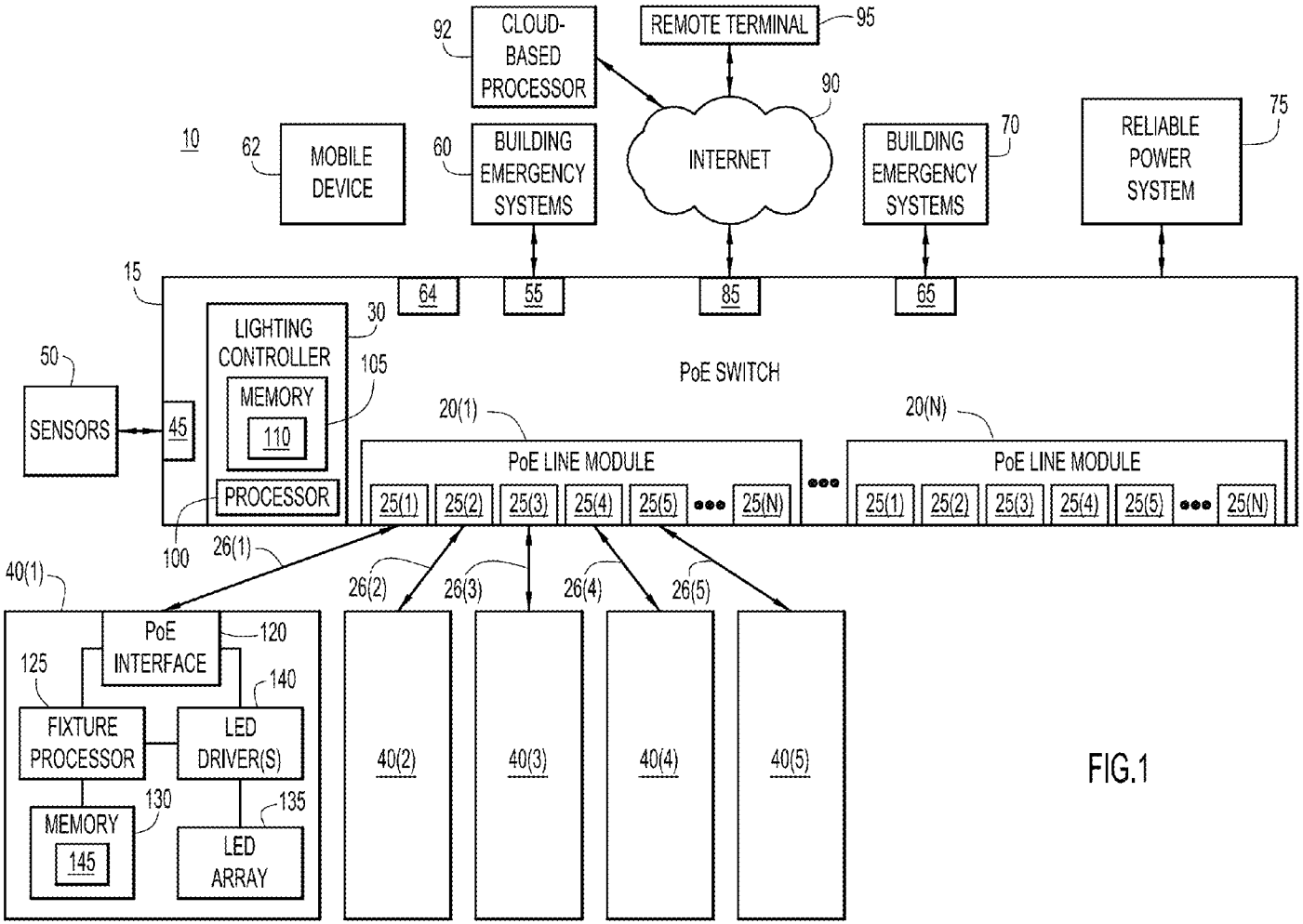
FIG. 1 is a block diagram of a networked lighting system in accordance with example embodiments presented herein.

FIG. 1 is a block diagram of a networked lighting system 10 deployed in a space, such as a commercial building, park, entertainment venue, etc. Merely for ease of description, examples presented herein are described with reference to system 10 deployed in a commercial building.

As shown in FIG. 1, networked lighting system 10 comprises a switch 15 that includes a plurality of line modules 20(1)-20(N) and a lighting controller 30. The switch 15 may be a Power-over-Ethernet (PoE) switch that uses PoE to provide both power and data to downstream devices using common star topology Ethernet cabling. As such, the line modules 20(1)-20(N) are sometimes referred to herein as PoE line modules 20(1)-20(N). While a PoE switch 15 is used in this example, the techniques presented herein are not limited to use with PoE. Instead, switch 15 may also use other communication mechanisms, such as other communications that provide both power and data to a downstream device using the same underlying transport (e.g., Ethernet). Other such communication mechanisms include, for example, PoE Plus (PoE+), Universal PoE (UPOE), and/or high power Universal Serial Bus (USB). Additionally, the techniques presented herein are applicable to systems that use traditional power sources to power the light fixtures and network connections (wired or wireless) to control the light fixtures (i.e., may be used with communication mechanisms that do not combine data and power).

The PoE line modules 20(1)-20(N) each include a plurality of ports (i.e., PoE ports) 25(1)-25(N). A subset of the ports 25(1)-25(N) are connected, via respective Ethernet cables 26(1)-26(N), to one or more networked multi-color light fixtures (multi-color light fixtures). In the example of FIG. 1, five (5) multi-color fixtures 40(1)-40(5) are shown in a 5×1 array. Each of the multi-color fixtures 40(1), 40(2), 40(3), 40(4), and 40(5) are connected to a respective one of the ports, namely ports 25(1), 25(2), 25(3), 25(4), and 25(5), respectively, of PoE line module 20(1) using a star or hub-and-spoke topology, where switch 15 is the hub and networked multi-color light fixtures 40(1)-40(*n*) are at the end of the spokes. It is to be appreciated that the specific number and arrangement of multi-color fixtures shown in FIG. 1 is merely illustrative, and other topologies or network types could be used.

The switch 15 also comprises one or more interfaces 45 for communication with sensors 50 within the building, one or more interfaces 55 for communication with the building emergency system(s) 60, and one or more interfaces 65 for communication with the building control system(s) 70. The switch 15 may also comprise one or more network interfaces 64 for communication with mobile devices, such as mobile device 62. Network interface(s) 64 may comprise, for example, Wi-Fi interfaces, 3G interfaces, Bluetooth interfaces, network interface ports, etc.

In the specific example of FIG. 1, the switch 15 receives power from a reliable power system 75. The reliable power system 75 may, for example, primarily receive power from a utility grid and include a back-up power mechanism (e.g., generators). The switch 15 also comprises one or more network interface units 85 that enable communication over one or more networks (e.g., Local Area Networks (LANs), Wide Area Networks (WANs), etc.), such as the Internet 90. A remote terminal 95 may be used by an administrator or other user to communicate with the switch 15 and control operations and/or settings thereof. Also shown in FIG. 1 is a cloud-based processor 92 that may communicate with switch 15 via Internet 90.

As noted, the switch 15 includes a lighting controller 30. The lighting controller 30 comprises a processor 100 and a memory 105 that includes communication control logic 110. Memory 105 may comprise read only memory (ROM), random access memory (RAM), magnetic disk storage media devices, optical storage media devices, flash memory devices, electrical, optical, or other physical/tangible memory storage devices. The processor 100 is, for example, a microprocessor or microcontroller that executes instructions for the communication control logic 110. Thus, in general, the memory 105 may comprise one or more tangible (non-transitory) computer readable storage media (e.g., a memory device) encoded with software comprising computer executable instructions and when the software is executed (by the processor 100) it is operable to control the multi-color light fixtures 40(1)-40(5) provide advanced services in the building.

More specifically, the processor 100 may execute communication control logic 110 to accept and process data inputs from one or more data sources (e.g., sensors 50, building systems 60/70, remote terminal 95, network connected mobile device 62, etc.). The processor 100 may execute communication control logic 110 to identify (based on the data inputs) a color informational display for presentation across a plurality of the multi-color light fixtures. As described further below, the color informational display provides information of local significance to users within the building or specific locations within the building. The processor 100 may execute communication control logic 110 to generate messages encoding light control settings for each of the plurality of multi-color light fixtures. The light control settings, when implemented at each of the multi-color light fixtures, results in the presentation of a spatial or temporal segment of the color informational display. The processor 100 may execute communication control logic 110 to send the messages to the plurality of light fixtures to create the color informational display across the plurality of multi-color light fixtures. These messages may direct individual multi-color light fixtures 40(1)-40(5) to each assume a specific static color state, with the message being conveyed through the pattern of static color states visible to the building occupants across an array of fixtures. Or, the messages may change the color states of the fixtures in a time sequence, creating various dynamic, flashing or moving displays.

Also as noted above, the switch 15 is connected to the multi-color fixtures 40(1)-40(5) via PoE ports and Ethernet cabling. Each of the multi-color fixtures 40(1)-40(5) have a substantially similar configuration in order to, as described further below, provide a communication platform enabling the presentation of color informational displays in accordance with advanced services. For ease of illustration, only the details of multi-color fixture 40(1) are shown in FIG. 1.

Multi-color fixture 40(1) includes a PoE interface 120, a fixture processor 125, an array 135 of light emitting diodes (LEDs), sometimes referred to herein as an "LED array," LED driver(s) 140, and a memory 130 that includes light fixture logic 145. As described further below, the LED array 135 includes a plurality of LED emitters. The memory 130 may comprise ROM, RAM, magnetic disk storage media devices, optical storage media devices, flash memory devices, electrical, optical, or other physical/tangible memory storage devices. The fixture processor 125 is, for example, a microprocessor or microcontroller that executes instructions for the light fixture logic 145. Thus, in general, the memory 130 may include one or more tangible (non-transitory) computer readable storage media (e.g., a memory device) encoded with software comprising computer executable instructions for the light fixture logic 145, and when the software is executed (by the fixture processor 125) it is operable to perform the operations described herein in connection with the networked lighting control techniques. In particular, fixture processor 125 may execute light fixture logic 145 so as to control the output of LED array 135 based on the messages received from switch 15 via the PoE port 25(1) and the associated Ethernet cable 26(1).

FIG. 1 illustrates a general arrangement for multi-color fixtures in accordance with examples presented herein. It is to be appreciated that a multi-color fixture may include other components that are not shown in FIG. 1. For example, other multi-color fixtures in accordance with examples presented herein may include sensors (e.g., to measure temperature, an actual light level emitted by LED array 135, etc.), power control circuits, an on-board battery, a battery controller/charger, etc. Additionally, the multi-color fixtures may have a number of different structural forms such as, for example, ceiling troffers, pendants, valances, strips, task lights, lighting integrated into furniture or cabinets, desk lamps, floor lamps, streetlights, high-bay lighting, etc. As described further below, each fixture is capable of emitting white light (possibly in multiple color temperatures) as well as colored light (using Red Green Blue (RGB) LED emitters). A single fixture may include multiple sets of emitters, arranged to emit individually controlled light in multiple directions or multiple spatial positions. The white light emitters provide the general lighting, and may contribute to the communications modes/informational displays described below. The RGB emitters can be a separate set of light emitters in the same fixtures, or in independent fixtures, and are used to convey messages, animations, and/or be used for various decorative purposes.

In operation and as described further below, the lighting controller 30 serves as a policy engine that coordinates and controls the color and brightness of each emitter within network light fixture 40(1)-40(5). The fixture processor 125 accepts messages from lighting controller 30 over PoE (i.e., via PoE port 25(1) and Ethernet cable 26(1)). The messages received from lighting controller 30 identify/define one or more operations or outputs, referred to herein as light control settings, for the LED array 135. In other words, the messages received from lighting controller 30 define selected operational outputs for the LED array 135. The light control settings include information/actions needed to set the exact brightness of emitter, and can also include instructions on how to vary that brightness over time. In one example, the light control settings have an eight (8) bit resolution for each emitter channel.

Figure 2:
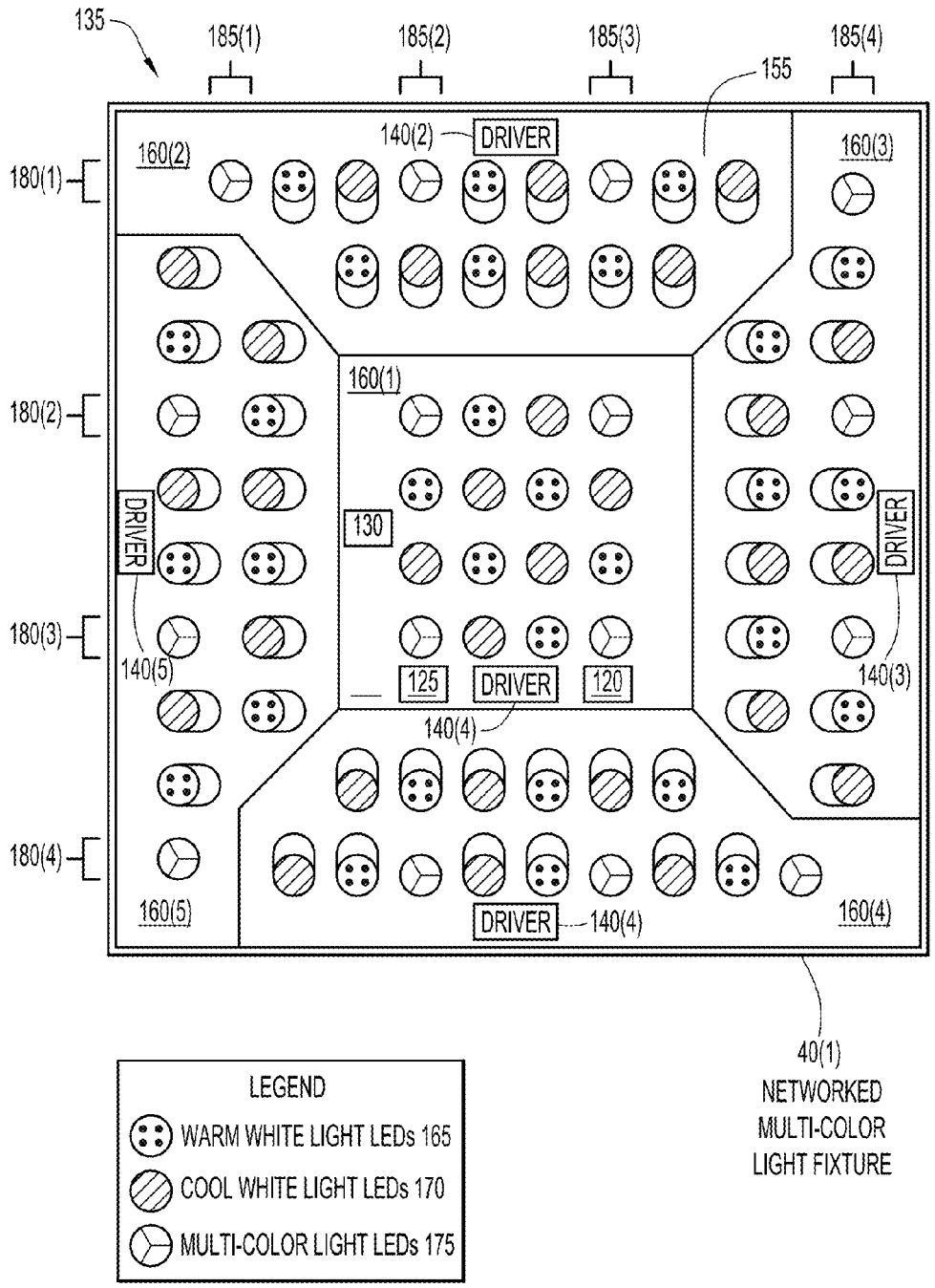
FIG. 2 is schematic diagram of a networked multi-color, multi directional light fixture in accordance with example embodiments presented herein.

FIG. 2 is a schematic diagram of an illustrative arrangement for a networked multi-color light fixture, such as multi-color fixture 40(1), in accordance with examples presented herein. After explanation of FIG. 2, the description will return to the example of FIG. 1 to describe further details of lighting controller 30 and the advanced color informational displays that may be provided to users in accordance with embodiments presented herein.

As shown in FIG. 2, the multi-color fixture 40(1) includes the PoE interface 120, the fixture processor 125, and memory 130 described above with reference to FIG. 1. As described further below, the LED array 135 includes a plurality of different types of separate LED emitters that may be activated to provide advanced color informational displays.

In one example, the light emitters forming LED array 135 are spread out over a light emission area 155 of the multi-color fixture 40(1). The light emission area 155 is divided into five (5) different emitting zones or sectors 160(1)-160(5) that each generally point in different directions. In other words, the light emission area 155 may have a generally pyramidal frustum (i.e., truncated pyramid) shape having four (4) lateral faces and an outer medial face that each emit light at different angles. Emitting zone 160(1) corresponds to the medial face and the emitting zones 160(2)-160(5) each correspond to one of the lateral faces of the pyramidal frustum surface 155. Each zone 160(1), 160(2), 160(3), 160(4), and 160(5) has an associated LED driver 140(1), 140(2), 140(3), 140(4), and 140(5), respectively, configured to drive the LEDs in the corresponding zone. Alternative examples may use substantially complainer circuit boards for all five emitting zones 160(1)-160(5), but the LED emitters are tilted in different directions for each zone.

In one example, the multi-color fixture 40(1) is a ceiling troffer configured to be positioned within an opening in a modular dropped ceiling grid. The multi-color fixture 40(1) may be configured to fit a standard architectural suspended ceiling grid as a drop-in troffer light. The specific example of the fixture shown in FIG. 2 may fit a twenty-four (24) inch square ceiling grid and provide approximately a light emission area 155 that is twenty-two (22) inches square.

In such examples, the zone 160(1) is generally directed substantially downwards (i.e., towards the floor), while the zones 160(2)-160(5) are each pointed/angled at a different direction that is tangential to the direction of zone 160(1). For example, zone 160(2) may point in a first direction (e.g., north) and towards the floor at angle (e.g., at an angle of 45 degrees) relative to zone 160(1), while zone 160(4) may point in a second direction that is generally opposite to the first direction (e.g., south) and towards the floor at an angle relative to zone 160(1). Additionally, zone 160(3) may point in a third direction that is generally orthogonal to the first and second directions (e.g., east) and towards the floor at angle relative to zone 160(1), while zone 160(5) may point in a fourth direction that is generally opposite to third direction and orthogonal to the first and second directions (e.g., west) and towards the floor at an angle relative to zone 160(1).

It is to be appreciated that reference to the direction of a zone refers to the direction at which the LED emitters within the LEDs in that zone primarily direct their associated light output. In other words, the LED emitters in each zone are angled to launch their radiated light preferentially in the direction of the zone 160(1)-160(5) in which the LED emitters are located. In certain examples, the LED emitters in the zones 160(2)-160(5) may be angled approximately 45 degrees from vertical to provide the directional control of the light, for example, to preferentially illuminate a wall or impinge light on a horizontal surface from multiple angles. In the illustrated embodiment, the white emitters (perhaps comprising sets of emitters of different color temperatures) emit at angles as described above, and the multi-color (RGB) emitters have a substantially hemispherical radiation pattern.

As noted above, the LED array 135 is formed from a number of different types of LED emitters. In particular, the LED array 135 includes LEDs with warm white light emitters (referred to herein as warm white light LEDs 165), LEDs with cool white light emitters (referred to herein as cool white light LEDs 170), and LEDs with multi-color light emitters (referred to herein as multi-color light LEDs 175). The Kelvin (K) temperature scale is generally used to describe the relative color appearance of white light, where white light appearing more red/orange is referred to as "warm" light while more blue light is referred to as "cool" light. Warm white light is generally in the range of approximately 2,700-3,000 K while cool white light has a color temperature of approximately 4,100K or greater. As such, in one example, the warm white light LEDs 165 are emitters having a color temperature of approximately 3,000 K and the cool white light LEDs 170 are emitters having a color temperature of approximately 5,000K. The fact that people associate warmth with red or orange objects is the reason why the "warm" descriptive name is used to describe the orange/red light, even though it is a cooler (lower) temperature on the Kelvin scale than the "cool" white light. It is to be appreciated that the above color temperatures are merely illustrative and that white light emitters in accordance with examples presented herein may have other color temperatures.

The multi-color light LEDs 175 each have separate red, green, and blue (RGB) emitters incorporated therein. The RGB emitters within a multi-color LED 175 may be activated individually or collectively in a number of manners such that the LED 175 may emit substantially any visible individual color (i.e., a fully controllable color output). Practical multi-color emitters 175 generally don't have the same luminous flux, energy efficiency or cost effectiveness as white emitters, so the certain embodiment make use of both types of emitters.

As shown in FIG. 2, each of the five zones 160(1)-160(5) includes comingled warm white light LEDs 165, cool white light LEDs 170, and multi-color LEDs 175. In the specific example of FIG. 2, each of the five zones 160(1)-160(5) includes six (6) warm white light LEDs 165 and (6) cool white light LEDs 170 positioned in a general checkered pattern. The warm and cool while light LEDs 165 and 170 may be blended (i.e., simultaneously activated, potentially at different power levels) to emit white light of varying color temperatures. In other words, by energizing both warm and cool emitters at partial brightness, a neutral color temperature (e.g., approximately 4000K) can be achieved for the space, which may be useful for office and/or commercial environments.

As shown in FIG. 2, zone 160(1) includes four (4) multi-color LEDs 175, while zones 160(2)-160(5) each includes three (3) multi-color LEDs 175, for a total of sixteen (16) multi-color LEDs 175 within the light emission area 155. The sixteen multi-color LEDs 175 are arranged into four rows 180(1)-180(4) and four columns 185(1)-185(4) creating a 4×4 array of multi-color LEDs. Additionally, the multi-color LEDs 175 within zone 160(1) are arranged as a 2×2 sub-array (i.e., the four central LEDs of the larger 4×4 array). As such, a four pixel color display is available within zone 160(1) while a sixteen pixel color display is available within the entire light emission area 155 comprised of forty-eight (48) full color channels (red, green, and blue individually controlled on 16 pixels). As described further below, the pixel color displays may be leveraged to display various spatial patterns as part of a color informational display.

In a specific example arrangement, the multi-color fixture 40(1) of FIG. 1 is an approximately 2 foot×2 foot square where the 4×4 array of 16 such pixels are positioned on a 6 inch grid (i.e., 6 inches between adjacent multi-color light LEDs). The multi-color fixture 40(1) may be built using five circuit boards. A central circuit board corresponds to zone 160(1) and hosts driver 140(1), fixture processor 125, memory 130, and PoE interface 120. Four additional circuit boards correspond to zones 160(2)-160(5) to implement the directional lighting, and are interconnected as slaves to the central circuit board 160(1). These four additional circuit boards may have substantially the same configurations to one another and host a respective driver 140(2)-140(5). The spacing of the edge rows (180(1) and 180(4)) and edge columns (185(1) and 185(4)) are chosen so that if identical multi-color light fixtures are installed in adjacent positions in a 2'×2' suspended ceiling grid, all the multi-color emitters in the extended array form a regular 6" spacing in both their rows and columns.

The light fixture 40(1) of FIG. 2 includes ten (10) white channels (cool and warm in each of five radiation directions), and 48 full color channels (red, green, and blue individually controlled on 16 pixels). This provides a total color state of 58 bytes (assuming 8-bit control per color channel), which can be downloaded as a single Ethernet message. Additionally, longer strings representing various color-time sequences can be downloaded to the light fixture 40(1), which are executed in a repeating "loop mode" by the local fixture processor 125 when commanded. In general, a loop mode is used with a temporal light pattern that is in presented on a given fixture for a period of time (e.g., a twinkling blue and white light near a restroom). Loop mode refers to a serial frame that is used by the fixture in a looping/continual manner to generate the repeated temporal light pattern. In operation, the lighting controller 30 provides the serial frame to the light fixture once and the light fixture local processor 125 continually executes the frame on its own. In certain examples, the serial frame may include or be associated with information identifying a time period (e.g., one hour, every 30 minutes, continually, etc.) that the light fixture is to execute the serial frame.

As described further below, these longer strings and loops may be used to implement various effects, such as fade, ramp, twinkle, flash, blink and strobe effects (uses of these to be described below). In one example, a 10 second loop with a 30 Hertz (Hz) frame rate covering all 58 channels in the exemplary fixture 40(1) would need approximately 17.4 K bytes, which can be transported over a 100 megabit per second (Mb/s) PoE link to the fixture in about 1.5 milliseconds, in a message set comprising approximately twelve standard (1500 payload byte) or two jumbo (9000 payload byte) Ethernet frames.

Returning to the example of FIG. 1, for ease of illustration each of the multi-color fixtures 40(1)-405) have substantially the same configuration as described in FIG. 2 for multi-color fixture 40(1). However, it is to be appreciated that the multi-color fixture 40(1)-40(5) may have other configurations. It is also assumed for ease of illustration that the multi-color fixtures 40(1)-40(5) are assembled into an array in the false ceiling of a room. In such examples, every panel in a ceiling could be a light fixture or a specific subset of grid locations could host the fixtures, while the rest of the ceiling is comprised of standard solid ceiling panels.

As noted above, the lighting controller 30 serves as a policy engine that coordinates and controls the color and brightness of each multi-color fixture 40(1)-40(5) for the presentation of color informational displays across a plurality of the multi-color light fixtures. That is, the lighting controller 30 provides local intelligence that is reliable, faster, more secure, and uses less backbone bandwidth than if the control system were implemented in a remote location (e.g., in the cloud). The lighting controller 30 may be configured, for example, by the building managers via a building management application at remote terminal 95. The lighting controller 30 may be configured with the basic lighting plan for the space, including the default brightness, light distribution pattern, color temperature, and individual RGB pixel colors for each multi-color fixture 40(1)-40(5). These default settings may convey the basic, static color-based messages and lighting states that building occupants will see every day. Default values may be used to set the fixture brightness and color temperature for general, task, accent and emergency lighting. They also may include color pixel settings to highlight specific features of a building (emergency exits, restrooms, emergency equipment, caution, restricted access, etc.).

The default lighting settings may be modified by building occupants (subject to a hierarchy of permissions checked by the policy engine of the lighting controller 30) to control the brightness, directionality, color temperature, and pixel colors of the light fixtures 40(1)-40(5) in their allowed domain of control. The lighting controller 30 accepts data inputs via one of a plurality of data sources (e.g., wall controls, portable building management terminals, applications on mobile devices or desktop computers, sensors, etc.) and validates the data inputs to determine whether the inputs comply with one or more predefined policies. For example, building occupants may want to adjust the brightness, color or light distribution pattern of the building's lights to better suit their tasks, activities, or moods. The lighting controller 30 determines which of the multi-color fixtures 40(1)-40(5) are involved in a request, determines if the requests comply with the predefined policies, formats messages that are encoded with light control settings for the involved light fixtures, and uses PoE to send the messages to the involved fixtures.

In addition to user inputs, there are also several classes/types of automatic operations that can effect changes to the settings of multi-color fixtures 40(1)-40(5) for initiation of color informational displays. For example, lighting controller 30 may use various time-synchronized events, such as building opening time, closing time, weekends and holidays, etc. to autonomously create commands to sending to the multi-color fixtures 40(1)-40(5) at the appropriate time(s). In certain examples, the lighting controller 30 may send messages to the multi-color fixtures 40(1)-40(5) that cause the light fixtures to perform lighting ramps, thereby creating dramatic effects (e.g., fading from red, to orange, to a warm white color temperature, to a cool white color temperature so as to simulate a sunrise). In other examples, clock chimes on the hour, half-hour, quarter-hour, etc. could cause selected light fixtures to perform a "flicker" or other indication of the time. These various effects may be managed by a scheduled event lists at the lighting controller 30.

The building's convenience and navigation features can also affect the color settings of the multi-color fixtures 40(1)-40(5). For example, a user can submit, via a navigation application, a request for a route or location of a specific target (e.g., location, person, room, device, etc.) within the building. The request may be, for example, "direct me to the nearest open conference room" or "how do I get from the elevator to Joe's office." Sensors within, for example, the building, a computing device, etc., can perform indoor localization to determine the location at which the query originated, identify the requested target and determine a path to the target. The lighting controller 30 may receive information indicating the current location of the user, a route to the target, etc. The lighting controller 30 may then generate commands that are sent to all light fixtures along the route such that the light fixtures collectively provide a specific pattern of color (e.g., using some of their RGB pixels) that conveys the directional instructions to the user. Such a color informational display could be a static path or an animated display (e.g., a chasing light display that can be followed by the user).

In another example, the lighting controller 30 could execute or cooperate with a stock ticker application that utilizes the RGB pixels of the multi-color fixtures 40(1)-40(5) to display a color informational display related to the stock price of a company. The pixels could display the actual stock price as a dot-matrix display across the ceiling and/or could change between red/green to convey the company's current stock performance.

Furthermore, the lighting controller 30 could execute or cooperate with emergency applications to use the multi-color fixtures 40(1)-40(5) to be a ubiquitous, impossible to ignore alarm signal for proving information to occupants in many different emergency scenarios (e.g., fire, smoke, lock-down/intrusion, tornado, earthquake, etc.). That is, the color informational display operates an alarm/warning system for building occupants to take specific actions.

In certain examples, the lighting controller 30 may be configured such that the operation of the entire lighting infrastructure is overridden by alarms from emergency sensor systems. For example, if a fire alarm is active, all RGB pixels of the multi-color fixtures 40(1)-40(5) could switch to bright red strobes. Furthermore, the array of flashing pixels across all the multi-color fixtures 40(1)-40(5) could produce animated paths, directing the occupants of each portion of the building to their closest exit with easy to follow sequential chasing light displays. The lighting controller 30 can be aware of conditions detected by the building emergency systems that may impact the evacuation (e.g., smoke in a stairwell) and change the animation accordingly to re-route occupants to a safer exit route. Similar path guidance could lead occupants directly to emergency equipment, such as fire extinguishers, defibrillators, crash carts, spill control kits, etc.

In addition, the lighting controller 30 may execute or cooperate with one or more entertainment/fun applications for presentation of color informational displays. Multi-color fixtures 40(1)-40(5) illustrate a subset of a large number (e.g., possible tens of thousands) of RGB pixels that may be present in a large open office building. In one example, lighting controller 30 could generate commands based on a display object, such as a photograph or even a video. These commands generated by lighting controller 30 could be sent to a number of light fixtures for use by the fixture processors to drive RGB pixels of in an appropriate pattern to create an image of the photograph on the ceiling (e.g., create a corporate or team logo, a flag, icon, or other symbol). The multi-color emitters in the ceiling in a 100×100 foot office space is effectively turned into a 200×200 pixel video display In other examples, the lighting controller 30 is configured to react to sound or music (e.g., on a public address system of the building) to control the color patterns of the lights in a space. Theatrical lighting setups could be emulated for performances, photography or videography, where the color, color temperature, brightness, and radiation pattern are controlled (by lighting control 30) in the light fixtures above and around the subjects to provide key, fill and backlights, and photographic strobes. In retail settings, individualized lighting plans could be created to best highlight the specific merchandise under each fixture.

As noted above, certain examples may use a "loop mode" to enable certain lighting effects. The loop mode may be used to download various dynamic color effects that have varying levels of implied urgency. More specifically, if all data for each channel is static for all timeslots, the light fixture emits constant brightness and color. However, if the data changes slowly from one color or brightness value to another over the multi-second duration of a pattern, a ramp pattern over intervals of seconds and/or fade effects are achieved. Ramping brightness up and/or down repeatedly over the interval of a second or two creates a waver effect. If the values abruptly change from low to high brightness and back again on different timescales, various blink, flash, and strobe effects result. Moving the brightness in small random increments can produce various sparkle, twinkle, or scintillate effects. Increasing levels of urgency of the message can be conveyed on all color channels via a hierarchy of these effects, in the approximate order of constant>fade>waver>blink>flash>strobe. If the primary white illumination channels are switched off as the alarm color is switched on in a rapid strobe, the highest level of urgency is conveyed. By combining the gamut of emitted colors with these different dynamic brightness effects, hundreds of unique, easily identifiable message states can be conveyed by each light fixture. The lighting controller 30 calculates the color pattern sequences to be executed by each light fixture for each situation, populates them into messages, sends them over the PoE links to the involved light fixtures, and triggers their synchronized execution across the network of fixtures.

FIG. 3 includes a table 200 illustrating examples of the types of color informational displays that could be conveyed by a large, ceiling mounted network of multi-color fixtures in communication with a lighting controller. The color informational displays could be programmable so that they are easy and intuitive to understand, even in the presence of cultural differences. Table 200 includes a first group 205 of color informational displays that correspond to alarms used in emergency situations and, as such, use bright saturated colors and a rapid strobe effect to attract maximum attention. In these examples, the primary white light emitters may be modulated in certain examples for use with the RGB pixels, making the color display seem extra urgent.

Table 200 also illustrates a second group 210 of color informational displays that make use of flashing lights (perhaps with an approximately 0.5 second on/0.5 second off pattern) to convey serious, but perhaps not life-threatening messages. A third group 215 of color informational displays use a blinking light pattern (e.g., 2 seconds on and 2 seconds off) to convey situations that require occupant caution. A fourth group 220 of color informational displays use a waver pattern (e.g., ramping brightness back and forth between two colors with perhaps 2 second cycle time) to convey somewhat less important information.

Also shown on table 200 is a fifth group 225 of color informational displays that use a slow fade between colors (e.g., a 10 second cycle time) as a gentle attention getting display that can be easily ignored. The informational displays of group 225 could be used after hours to remind visitor that the security system is armed, and could also be the default states of the lights immediately over rest rooms, drinking fountains, etc., so someone looking down a corridor can instantly find these locations. A sixth group 230 of color informational displays corresponds to guidance messages that make use of animated chasing light sequences spanning many fixtures to delineate a path to follow. A seventh group 235 of color informational displays corresponds to lighting messages that may be static, for entertainment, marketing, etc. It is to be appreciated that the color informational displays shown in FIG. 3 are merely illustrative and that many variants are possible.

Figure 4:
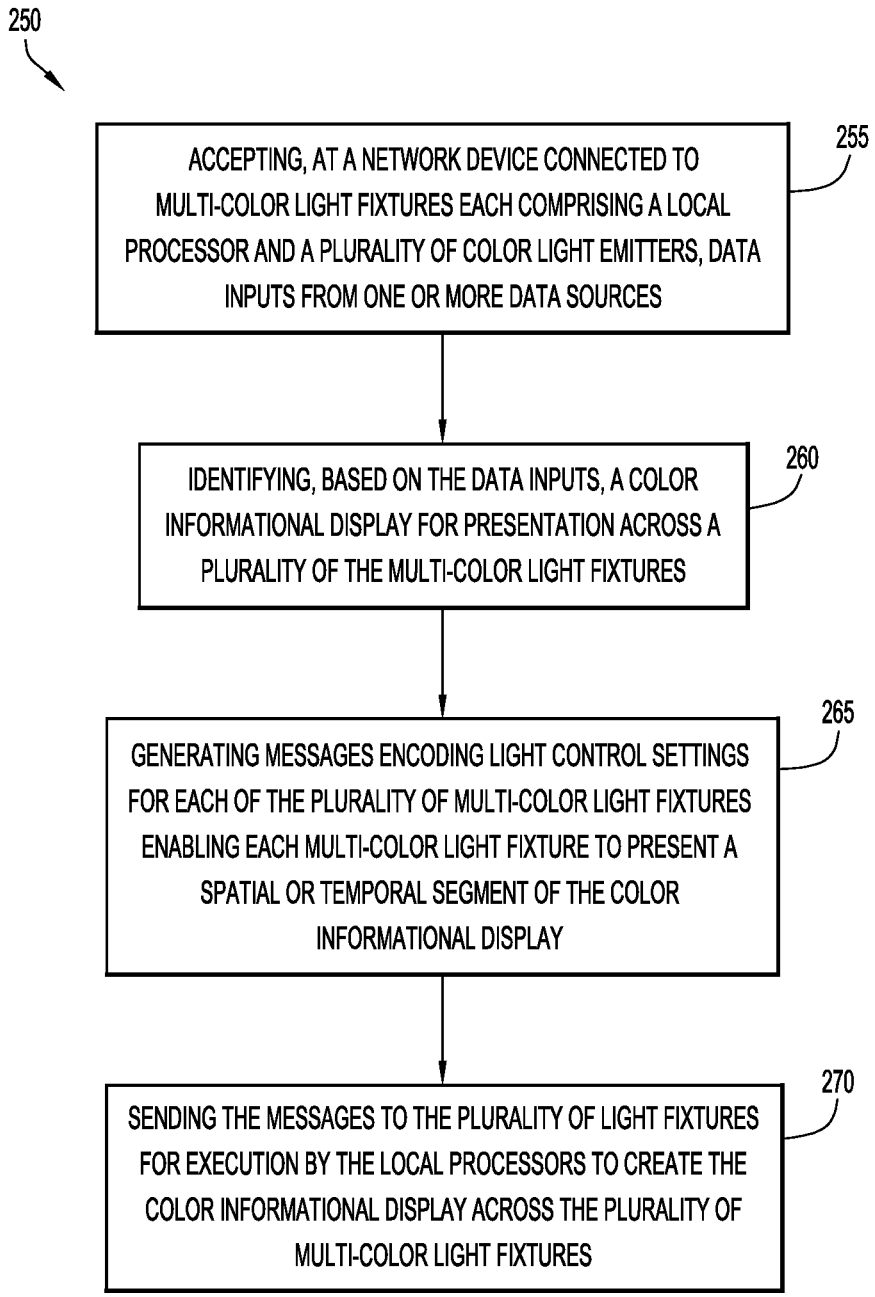
FIG. 4 is a flowchart of a method in accordance with example embodiments presented herein.

In general, presented herein are techniques for providing a rich communication environment enabled by smart, color-controllable light fixture networks, and the shared equipment and algorithms that control and coordinate large networks of such light fixtures. FIG. 4 is a flowchart of a method 250 in accordance with the techniques presented herein. Method 250 begins at 255 where a network device, which is connected to multi-color light fixtures each comprising a local processor and a plurality of color light emitters, receives/accepts data inputs (e.g., commands) from one or more data sources. At 260, the network device identifies, based on the data inputs, a color informational display for presentation across a plurality of the multi-color light fixtures. At 265, the network device generates messages encoding light control settings for each of the plurality of multi-color light fixtures. The messages enable each multi-color light fixture to present a spatial or temporal segment of the color informational display. At 270, the messages are sent to the plurality of light fixtures for execution by the local processors to create the color informational display across the plurality of multi-color light fixtures.

The techniques presented herein use multiple colors of light presented via a network of multi-color light fixtures for communication with occupants of a space. The multi-color light fixtures are attached to a network and controlled in response to user, sensor, or other data inputs. Various colors and flash patterns can assist in guidance, emergency responses, and advanced lighting scenarios. In certain examples, each light fixture in a space is individually programmable with brightness, color temperature, radiation pattern and RGB color. Light fixtures are coordinated both spatially and temporally to enable the creation of patterns, images, and animations. Additionally, a lighting system may be integrated with input devices like wall switches, control panels, handheld devices, etc., thereby enabling managers and building occupants to run applications and control the lighting system. Various sensors and automatic emergency systems can take control of the lighting system, and use it to convey emergency alarms, instructions, the location of emergency equipment or evacuation routes Thus, in one form, a method is provided comprising: accepting, at a network device connected to multi-color light fixtures each comprising a local processor and a plurality of color light emitters, data inputs from one or more data sources; identifying, based on the data inputs, a color informational display for presentation across a plurality of the multi-color light fixtures; generating messages encoding light control settings for each of the plurality of multi-color light fixtures enabling each multi-color light fixture to present a spatial or temporal segment of the color informational display; and sending the messages to the plurality of light fixtures for execution by the local processors to create the color informational display across the plurality of multi-color light fixtures.

In another form, an apparatus is provided comprising: one or more network interface devices connected to multi-color light fixtures each comprising a local processor and a plurality of color light emitters; a memory; and a processor that: accepts data inputs from one or more data sources, identifies, based on the data inputs, a color informational display for presentation across a plurality of the multi-color light fixtures, generates messages encoding light control settings for each of the plurality of multi-color light fixtures enabling each multi-color light fixture to present a spatial or temporal segment of the color informational display, and sends the messages to the plurality of light fixtures for execution by the local processors to create the color informational display across the plurality of multi-color light fixtures.

In still another form, one or more computer readable storage media are provided encoded with software comprising computer executable instructions and when the software is executed operable to: accept, at a network device connected to multi-color light fixtures each comprising a local processor and a plurality of color light emitters, data inputs from one or more data sources; identify, based on the data inputs, a color informational display for presentation across a plurality of the multi-color light fixtures; generate messages encoding light control settings for each of the plurality of multi-color light fixtures enabling each multi-color light fixture to present a spatial or temporal segment of the color informational display; and send the messages to the plurality of light fixtures for execution by the local processors to create the color informational display across the plurality of multi-color light fixtures.

Although the techniques are illustrated and described herein as embodied in one or more specific examples, it is nevertheless not intended to be limited to the details shown, since various modifications and structural changes may be made within the scope and range of equivalents of the claims.

What is claimed is:

1. A method comprising:

receiving, at a network device connected to a plurality of multi-color light fixtures each comprising a local processor and a plurality of color light emitters, a query requesting a location of a specific target;

identifying the location of the specific target;

identifying a location associated with a source of the query;

identifying, based on the query, a color informational display for presentation across the plurality of the multi-color light fixtures;

generating messages encoding light control settings enabling one or more multi-color light fixtures in proximity to the specific target to present a color informational display that identifies the location of the specific target and that is visible from the location associated with the source of the query; and sending the messages to the plurality of light fixtures for execution by the local processors to create the color informational display across the plurality of multi-color light fixtures.

2. The method of claim 1, wherein the plurality of color light emitters in a multi-color light fixture comprise multi-color light emitting diodes (LEDs) that include red, green, and blue emitters, and wherein the multi-color LEDs are arranged into rows and columns forming a pixel color display.

3. The method of claim 1, further comprising:

validating the query to determine whether the query complies with one or more predefined policies.

4. The method of claim 1, further comprising:

generating messages encoding light control settings enabling the one or more multi-color light fixtures between the location associated with the source of the query and the specific target to generate a color informational display identifying a route from the location associated with the source of the query to the specific target.

5. The method of claim 4, wherein the color informational display identifying the route from the location associated with the source of the query to the specific target is a chasing light display.

6. The method of claim 1, wherein sending the messages to the plurality of light fixtures comprises:

sending the messages via Power over Ethernet (POE).

7. The method of claim 1, wherein at least one of the multi-color light fixtures comprises a light emission area divided into a plurality of emitting zones angled in different directions.

8. The method of claim 7, wherein the light emission area has a generally pyramidal frustum shape with four lateral faces and an outer medial face, wherein each of the four lateral faces and the outer medial face each corresponds to an emitting zone that each emits light at different angles.

9. The method of claim 8, wherein the four lateral faces are angled at approximately forty-five (45) degrees relative to the outer medial face.

10. The method of claim 7, wherein each emitting zone includes warm white light emitting diodes (LEDs), cool white light LEDs, and multi-color LEDs that include red, green, and blue emitters.

11. The method of claim 7, wherein the light emission area has a plurality of co-planar emitting zones each including a plurality of emitters, and wherein emitters in each of the emitting zones are angled such that each emitting zone emits light at different angles.

12. The method of claim 1, wherein the messages encoding light control settings for each of the plurality of multi-color light fixtures comprise messages that includes brightness values for multiple color channels in each of the plurality of multi-color light fixtures.

13. The method of claim 1, wherein the messages encoding light control settings comprise messages that include multiple temporal frames that are sequentially displayed on each of the plurality of multi-color light fixtures.

14. An apparatus, comprising:

one or more network interface devices connected to a plurality of multi-color light fixtures each comprising a local processor and a plurality of color light emitters;

a memory; and a processor that:

receives a query requesting a location of a specific target, identifies the location of the specific target, identifies a location associated with a source of the query, identifies, based on the query, a color informational display for presentation across the plurality of the multi-color light fixtures, generates messages encoding light control settings enabling one or more multi-color light fixtures in proximity to the specific target to present a color informational display that identifies the location of the specific target and that is visible from the location associated with the source of the query control settings for each of the plurality of multi color light fixtures enabling each multi, and sends the messages to the plurality of light fixtures for execution by the local processors to create the color informational display across the plurality of multi-color light fixtures.

15. The apparatus of claim 14, wherein the processor:

validates the query to determine whether the query complies with one or more predefined policies.

16. The apparatus of claim 14, wherein the processor further:

generates messages encoding light control settings enabling the one or more multi-color light fixtures between the location associated with the source of the query and the specific target to generate a color informational display identifying a route from the location associated with the source of the query to the specific target.

17. The apparatus of claim 16, wherein the color informational display identifying the route from the location associated with the source of the query to the specific target is a chasing light display.

18. The apparatus of claim 14, wherein to send the messages to the plurality of light fixtures, the processor:

sends the messages via Power over Ethernet (POE).

19. One or more non-transitory computer readable storage media encoded with software comprising computer executable instructions and when the software is executed operable to:

receive, at a network device connected to a plurality of multi-color light fixtures each comprising a local processor and a plurality of color light emitters, a query requesting a location of a specific target;

identify the location of the specific target;

identify a location associated with a source of the query;

identify, based on the data inputs, a color informational display for presentation across the plurality of the multi-color light fixtures;

generate messages encoding light control settings enabling one or more multi-color light fixtures in proximity to the specific target to present a color informational display that identifies the location of the specific target and that is visible from the location associated with the source of the query; and send the messages to the plurality of light fixtures for execution by the local processors to create the color informational display across the plurality of multi-color light fixtures.

20. The computer readable storage media of claim 19, further comprising instructions operable to:

validate the query to determine whether the query complies with one or more predefined policies.

21. The computer readable storage media of claim 19, further comprising instructions operable to:

generate messages encoding light control settings enabling the one or more multi-color light fixtures between the location associated with the source of the query and the specific target to generate a color informational display identifying a route from the location associated with the source of the query to the specific target.

22. The computer readable storage media of claim 21, wherein the color informational display identifying the route from the location associated with the source of the query to the specific target is a chasing light display.

23. The computer readable storage media of claim 19, wherein the instructions operable to send the messages to the plurality of light fixtures comprise instructions operable to:

send the messages via Power over Ethernet (POE).

* * * * *